US007614542B2

(12) United States Patent
Lo Duca

(10) Patent No.: US 7,614,542 B2
(45) Date of Patent: Nov. 10, 2009

(54) BOX WITH INVIOLABLE SECURITY SEAL

(75) Inventor: Carmelo Lo Duca, Milan (IT)

(73) Assignee: GI.BI.EFFE S.r.l., Milan (IT)

( * ) Notice: Subject to any disclaimer, the term of this patent is extended or adjusted under 35 U.S.C. 154(b) by 0 days.

(21) Appl. No.: 12/206,997

(22) Filed: Sep. 9, 2008

(65) Prior Publication Data

US 2009/0072018 A1 Mar. 19, 2009

(30) Foreign Application Priority Data

Sep. 13, 2007 (IT) ..... MI2007A1758

(51) Int. Cl.
*B65D 5/43* (2006.01)
*B65D 5/4805* (2006.01)

(52) U.S. Cl. ..... 229/102; 229/122.32; 229/122.33; 229/148; 229/151; 229/153

(58) Field of Classification Search ..... 229/102, 229/148–153, 122.32, 122.33; 206/807
See application file for complete search history.

(56) References Cited

U.S. PATENT DOCUMENTS

| | | | | | |
|---|---|---|---|---|---|
| 636,806 | A | * | 11/1899 | Johnstone | 229/148 |
| 3,233,818 | A | * | 2/1966 | Bixler et al. | 229/117.34 |
| 4,063,678 | A | * | 12/1977 | Hall | 229/102 |
| 4,479,588 | A | * | 10/1984 | Davis et al. | 229/102 |
| 4,830,270 | A | * | 5/1989 | Holmes | 229/102 |
| 4,917,288 | A | * | 4/1990 | Heitele et al. | 229/102 |
| 5,207,374 | A | * | 5/1993 | Lo Duca | 229/102 |
| 5,314,114 | A | * | 5/1994 | Stone | 229/122.32 |
| 5,337,951 | A | * | 8/1994 | Roccaforte | 229/186 |
| 5,803,345 | A | * | 9/1998 | Jones et al. | 229/102 |
| 6,860,421 | B2 | | 3/2005 | Lo Duca | |
| 7,267,261 | B2 | | 9/2007 | Lo Duca | |
| 2006/0124708 | A1 | | 6/2006 | Lo Duca | |
| 2007/0102499 | A1 | | 5/2007 | Lo Duca | |

FOREIGN PATENT DOCUMENTS

| | | | | | |
|---|---|---|---|---|---|
| DE | 77 01 109 | U1 | | 6/1977 | |
| EP | 0 709 293 | A1 | | 5/1996 | |
| EP | 1 340 684 | A2 | | 9/2003 | |
| EP | 1 538 090 | A1 | | 6/2005 | |
| EP | 1 826 129 | A2 | | 8/2007 | |
| FR | 2 504 892 | | | 11/1982 | |
| GB | 2251600 | A | * | 7/1992 | 229/102 |
| JP | 3-226451 | A | * | 10/1991 | 229/102 |
| WO | WO 2007/087600 | A2 | | 8/2007 | |

* cited by examiner

*Primary Examiner*—Gary E Elkins
(74) *Attorney, Agent, or Firm*—Oblon, Spivak, McClelland, Maier & Neustadt, L.L.P.

(57) ABSTRACT

A box formed from a single piece of punched and crease-lined cardboard sheet, the box having an inviolable security seal which is broken when the closed box is opened for the first time. The closed box presents a high resistance to deformation when subjected to external stresses.

2 Claims, 5 Drawing Sheets

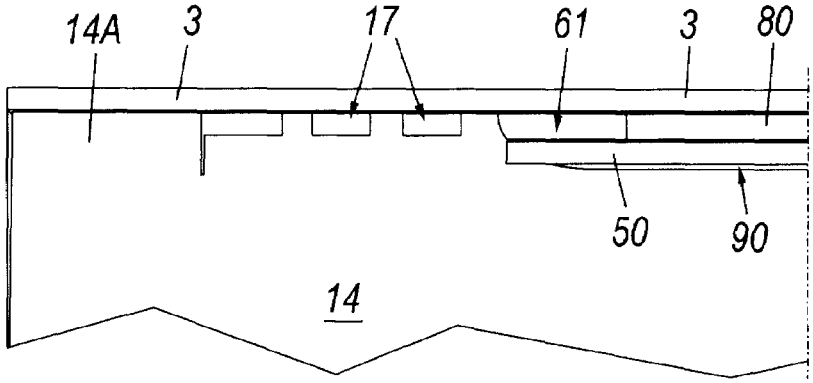
Fig. 10
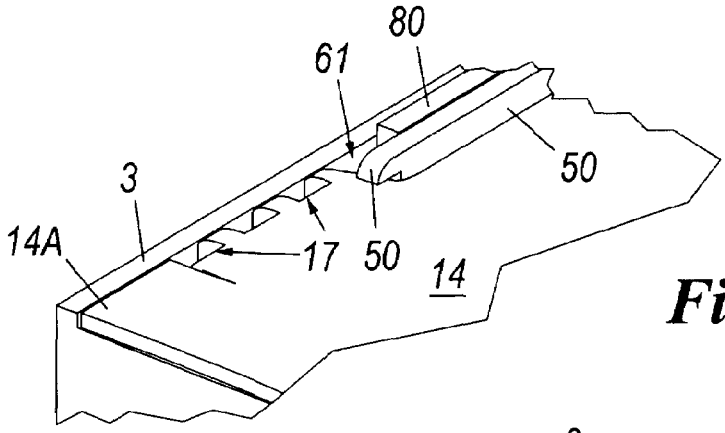
Fig. 11
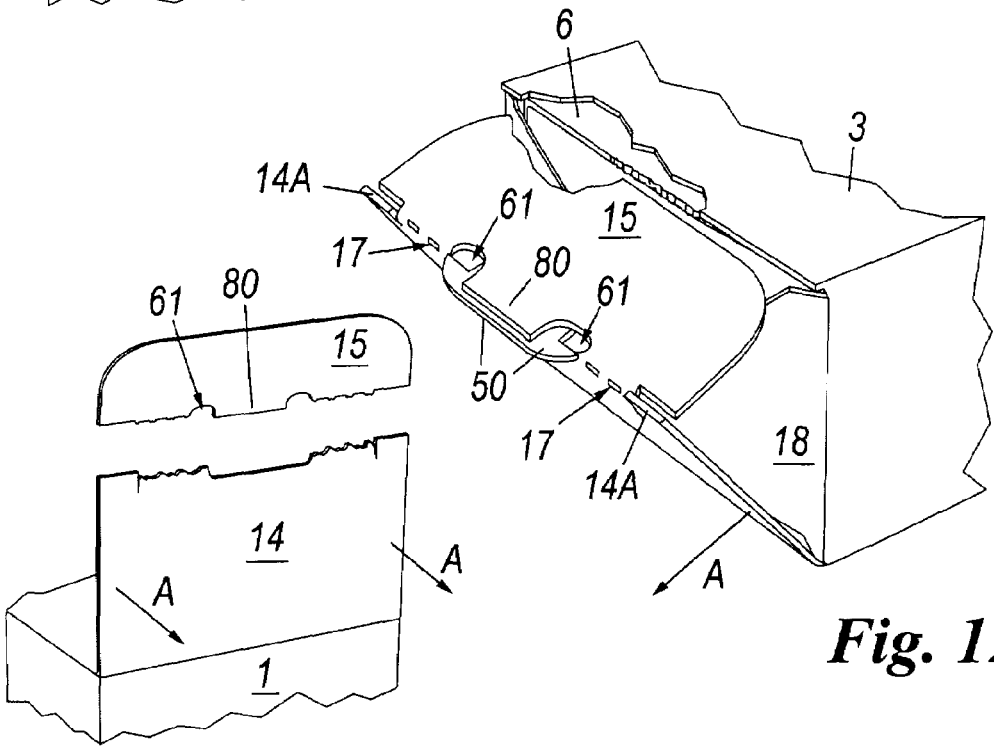
Fig. 12
Fig. 13

BOX WITH INVIOLABLE SECURITY SEAL

FIELD OF THE INVENTION

The present invention relates to a box formed from a single piece of cardboard sheet, the closed box having high resistance to deformation and comprising an inviolable security seal which is broken when the box is opened for the first time.

BACKGROUND OF THE INVENTION

Many types of boxes are known provided with a security seal, the purpose of which is to make it evident by simple external examination that the initially closed box has already been opened for the first time, or to cause a portion of the box lid or a portion of the box itself to separate after initial opening, to prevent its reclosure.

DISCUSSION OF THE RELATED ART

Boxes of this type are described, for example, in EP 0709293 B, EP 1340684 B and in the corresponding U.S. Pat. No. 6,860,421 B, EP 1538090 A and in the publication US 2006/0124708 A1, all in the name of the present applicant.

All the security seals illustrated in the known patents, including the aforestated, can however be violated if the boxes are opened with great care using thin metal blades to raise and deform small portions of the box or of its lid.

Boxes formed from a single piece of cardboard are generally of parallelepiped shape and are closed or closable by rotatable lids, formed from the same piece of cardboard.

EP 1826129 A2 and the corresponding U.S. Ser. No. 11/622,724, also in the name of the present applicant, describe a box formed from a single piece of cardboard and comprising an internal supplementary wall which defines—inside the box—a supplementary pocket or cavity adjacent to that outer side wall of the box which faces or opposes that box wall from which the two box closure lids or panels project, the function of this supplementary pocket being to divide the box internal cavity into two separate parts: it is important to note that said internal supplementary wall of the box has no stiffening function (or deformation resistance increase) for the closed box structure.

SUMMARY OF THE INVENTION

An object of the present invention is therefore to form a box, obtained from a single piece of cardboard sheet, which is provided with an inviolable security seal, i.e. such that access can be gained to the box interior (after its initial closure) only after the seal has been broken, hence making it apparent to the naked eye that the box closure lid (or lids) has/have been opened for the first time.

Another object is to form a box provided with an inviolable security seal in which the box has high resistance to deformation when closed and its security seal is intact.

These and other objects are attained by a box formed from a single piece of punched and crease-lined cardboard sheet, the box being of substantially parallelepiped shape with four outer side walls, two lids for closing two box ends and each projecting from one end of one of said side walls, and a supplementary wall inside the box close to that box side wall opposing the side wall from which said lids extend, of which at least one is divided into an end panel and into a free lip by a folding line substantially parallel to a folding line which separates the said end panel from that box side wall from which it extends, characterised in that from at least one free edge of said supplementary panel there extends at least one hook-shaped appendix the free end of which is widened, in the end panel of the box lid on the same side as said shaped appendix there being provided at least one cut close to the folding line which separates it from the respective free lip, said cut having a length less than the width of the free end of said hook-shaped appendix which passes through and extends beyond the cut when the box lid is closed, at each of the two ends of said cut in the lid panel there being provided in the cardboard a hole which extends from each end of said cut towards the outside of the cut and into the lid lip, there being provided in the cardboard at least one preferential breakage line formed from at least one cut or knurling which at least partially incises is the cardboard, said preferential breakage line being provided either on said shaped appendix or on said box lid between the respective end panel and free lip, or on both of them.

Preferably and advantageously, the length of the supplementary panel considered as the distance between its opposing free edges is less than the length of that outer box side wall opposite the side wall from which said lid extends.

By virtue of its structure the box, when its lids are closed, assumes high rigidity and deformation resistance, enabling (inter alia) the use of cardboard sheets of thickness, weight and cost less than those required to form similar boxes, but without the characteristics of the box of the present invention.

Moreover, by virtue of the fact that said hook-shaped appendix extends within the box, when closed, and through the cut provided in the corresponding lid end panel, and is hooked (after being passed beyond the two holes provided at the ends of the cut) onto the panel outer surface, an absolutely inviolable seal is formed which is broken (when the box is opened for the first time) along the preferential breakage lines provided in the cardboard.

BRIEF DESCRIPTION OF THE DRAWINGS

A preferred embodiment of the box is described hereinafter by way of non-limiting example, with reference to the accompanying drawings, in which.

Figure 5:
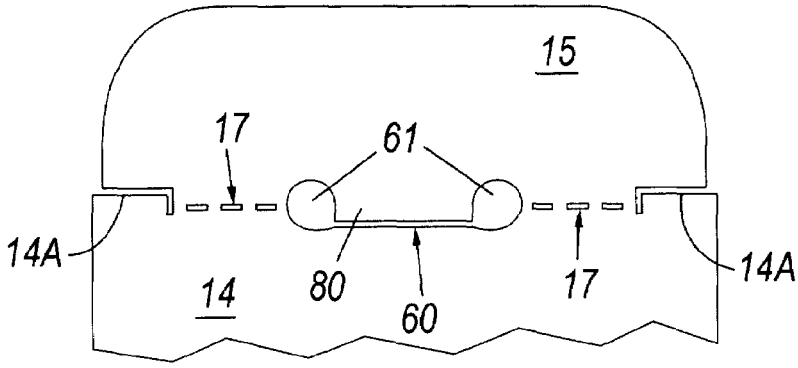
Figure 6:
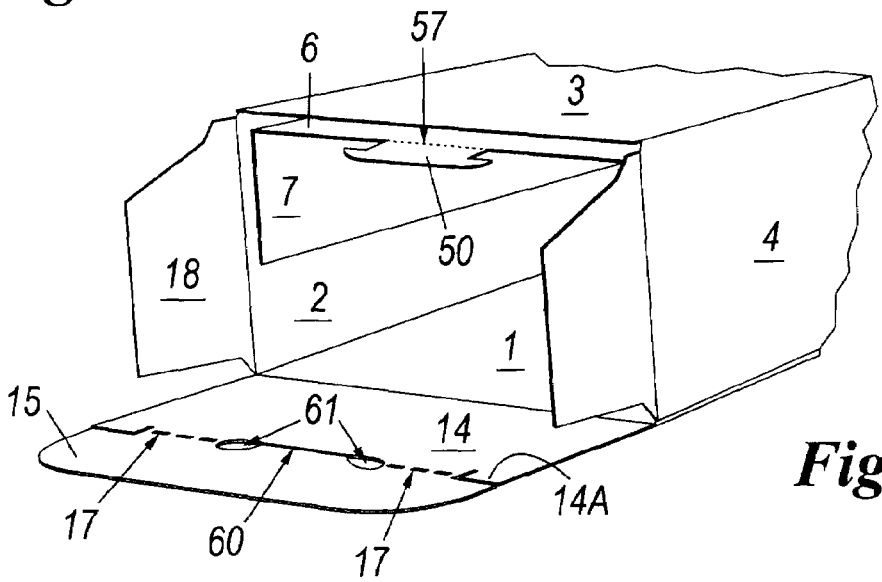
Figure 7:
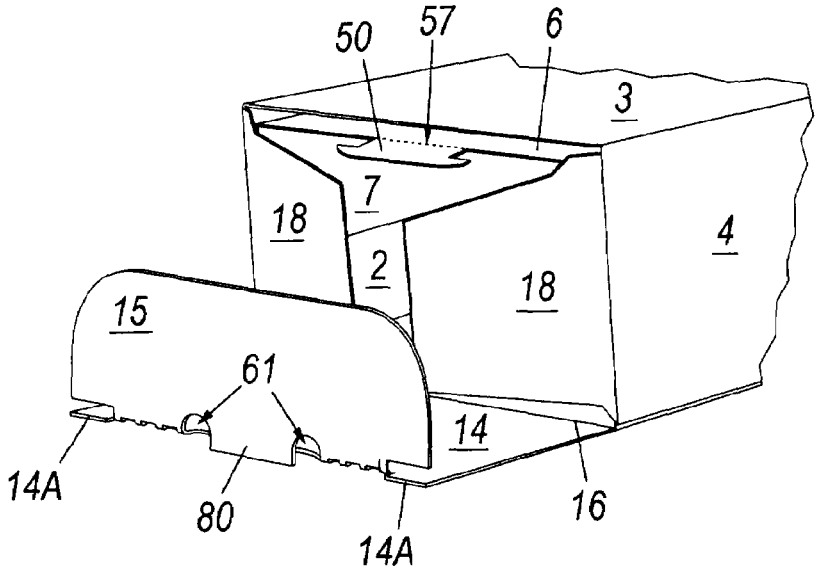
Figure 8:
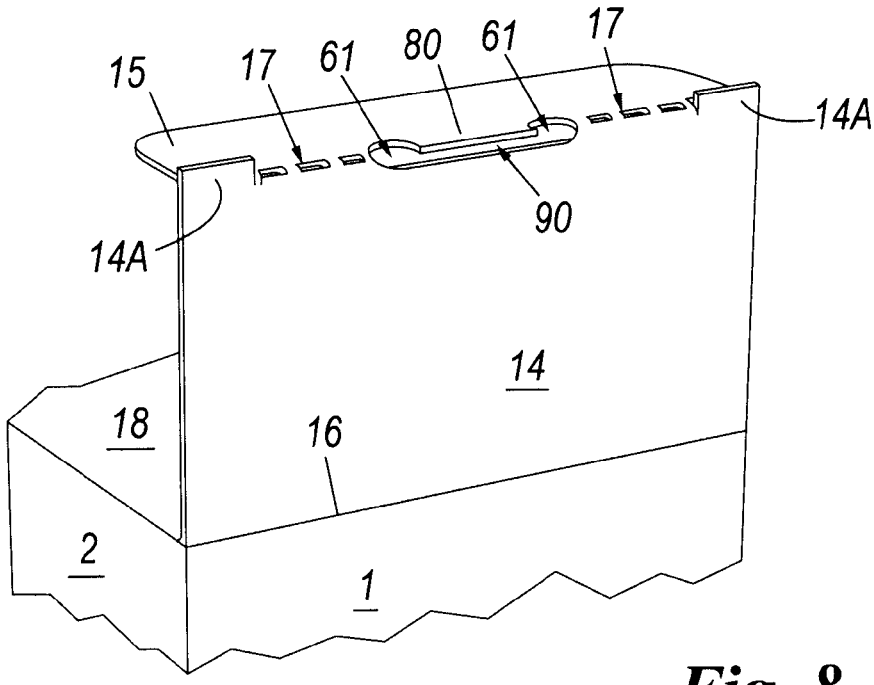
Figure 9:
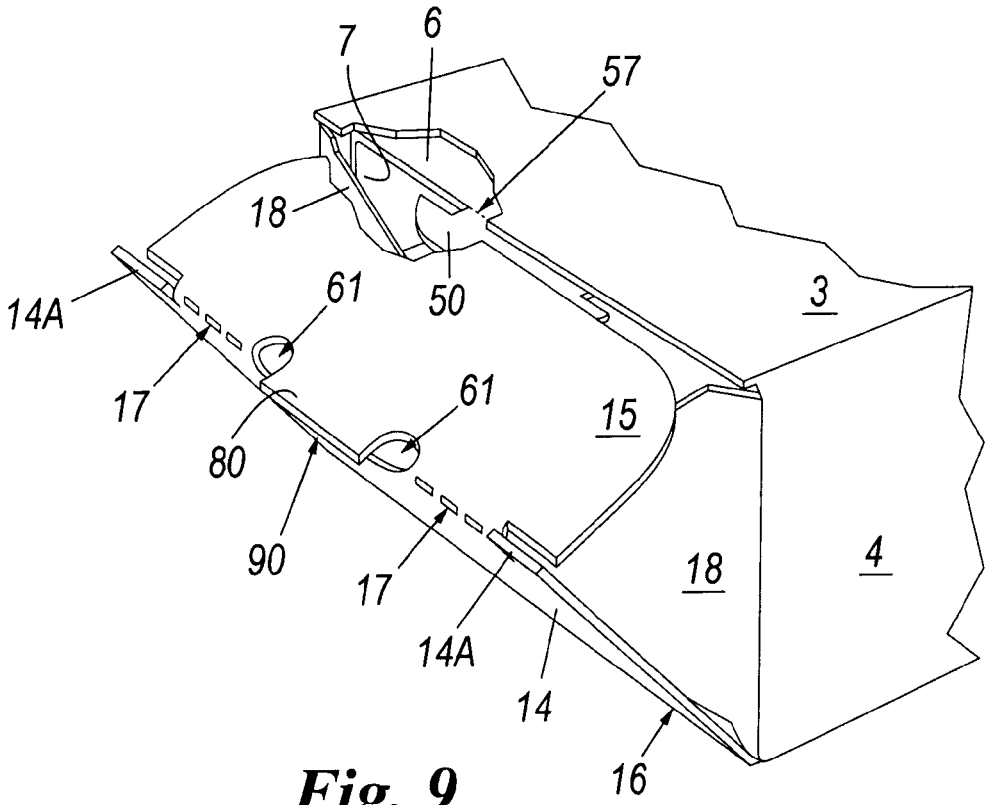

Figures from 2 to 4 show said cardboard piece in its successive folding and gluing steps to give a finished box, ready for despatch to a box user firm;

FIG. 5 shows, on a greatly increased scale, a portion of one of the box closure lids;

FIG. 6 is an enlarged perspective view of one end of a box, with the box lid and the adjacent flaps completely open, as at the moment in which an automatic machine (not represented) of a user firm is about to insert into it, through the open lid, the product which the box is intended to contain and protect;

FIG. 7 is similar to FIG. 6, from which it differs by the fact that the box flaps and the lid lip are bent towards the box interior and upwards respectively;

FIG. 8 shows, also in perspective view, that box portion of FIG. 7 seen from the rear, i.e. opposite that in which the same box portion is seen in FIG. 7;

FIG. 9 shows, on a further enlarged scale, the same box portion as Figures from 6 to 8, but represented in a subsequent folding step, i.e. in a step immediately preceding lid closure and insertion of the lid lip into the box, to close the adjacent box end;

FIGS. 10 and 11 are partial representations, one in frontal view and the other perspective, of that end portion of the closed box in which the intact security seal is provided, i.e. with the box inviolated;

FIG. 12 shows the same box end, with its lid partially open and with one of its security seals irreparably broken; and FIG. 13 is a simplified perspective view of that box end the lid of which has been completely opened, after necessarily breaking a security seal different from that of FIG. 12.

DETAILED DESCRIPTION OF THE INVENTION

Figure 1:
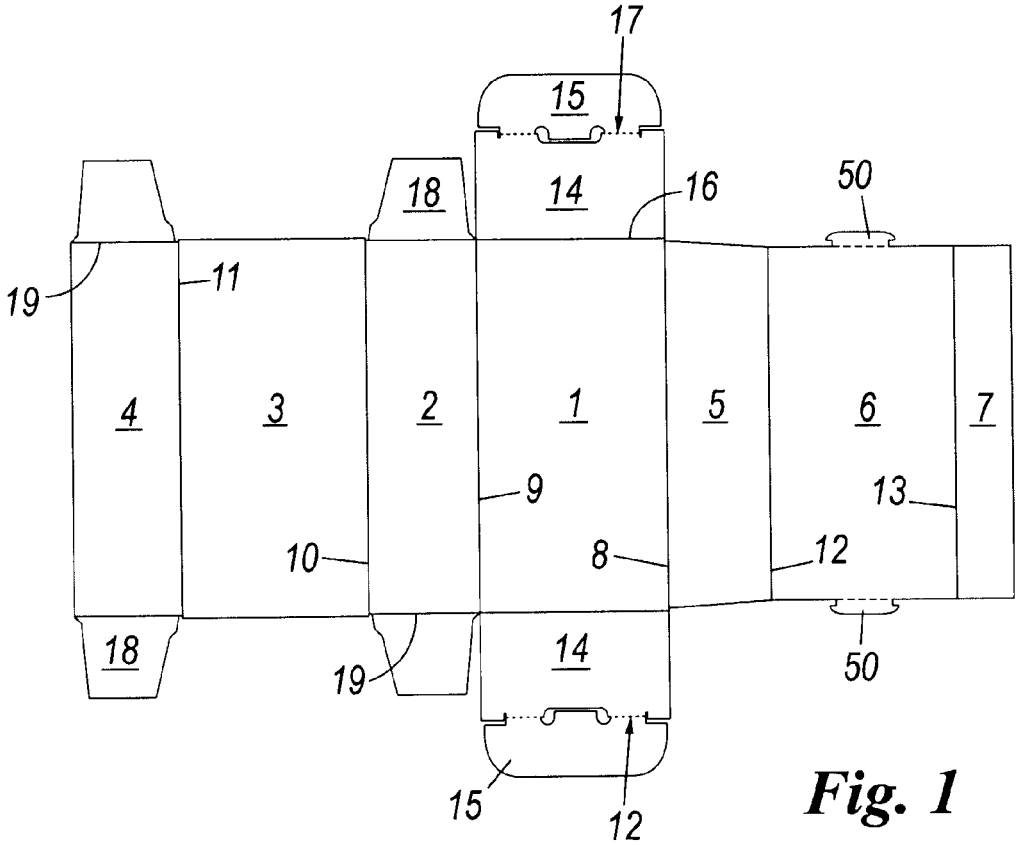
FIG. 1 is a flatly spread plan view of the punched and crease-lined cardboard piece usable for forming a box.

FIG. 1 shows in spread-out plan view a piece of punched and crease-lined cardboard comprising four main panels or walls 1-4 (intended to form the box outer surface) and three mutually consecutive panels 5, 6 and 7 projecting laterally from the main panel 1, the panels 1-7 being separated from each other by longitudinal parallel crease lines (or folding lines) 8-13. From each end of the panel 1 there projects a lid comprising an end panel 14 and a free lip 15, the end panel 14 being separated from the panel 1 by a transverse folding line 16 and from the lip 15 by a folding line 17: this latter, in the embodiment shown in the drawings, consists of two short (aligned) lengths of knurling, i.e. each formed by a succession of small cuts which pass through the entire cardboard thickness, known in the art as "knurlings". It should however be noted that the folding lines 17 can consist of common crease lines without cuts, or can be each formed by a continuous cut line which incises the cardboard only through a part of its thickness (such as not to cause detachment of the lip 15 from the lid panel 14).

Finally it should be noted that from the opposing free ends of the panels 2 and 4 there project flaps 18 divided from such panels by folding lines or crease-lines 19 perpendicular to the lines 8-13, as is usual in known boxes similar to that described herein.

The punched and crease-lined cardboard piece described up to this point is substantially equal to that of known boxes, for example that represented in EP 1826129 A2 and in the already aforestated corresponding US patent application.

Figure 2:
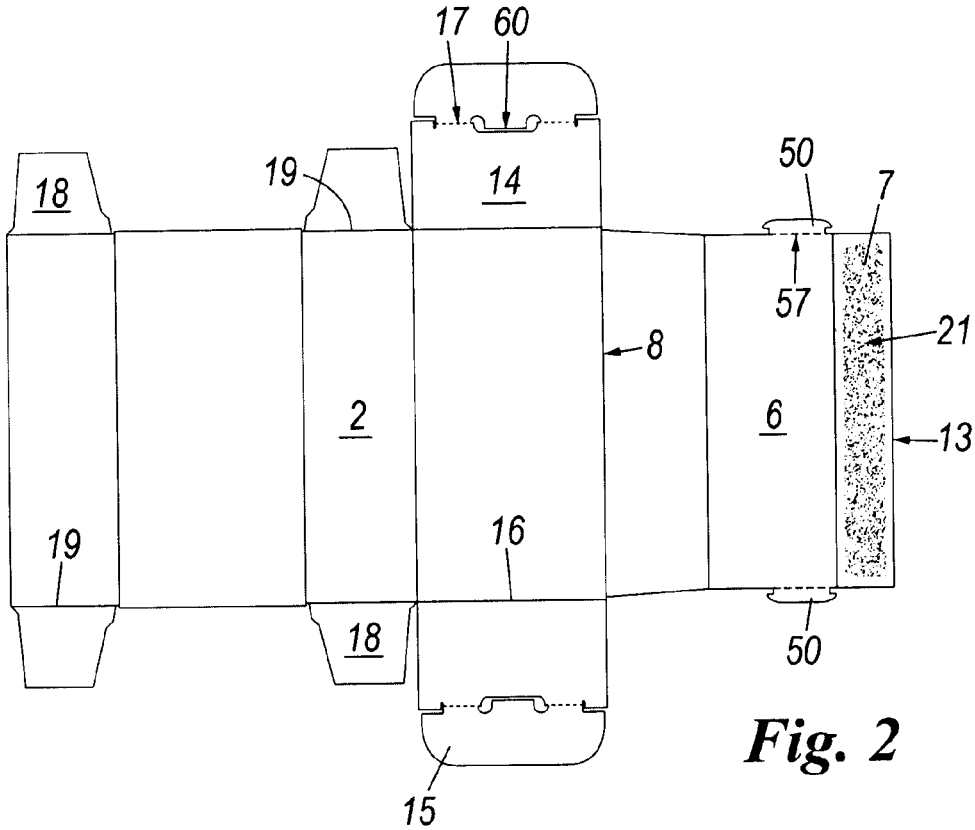

To shape this cardboard piece into a box, the end panel 7 is firstly turned onto the secondary panel 6 (by rotating it about the folding line 13), then a glue strip 21 is applied to that surface of the panel 1 facing upwards (FIG. 2).

Figure 3:
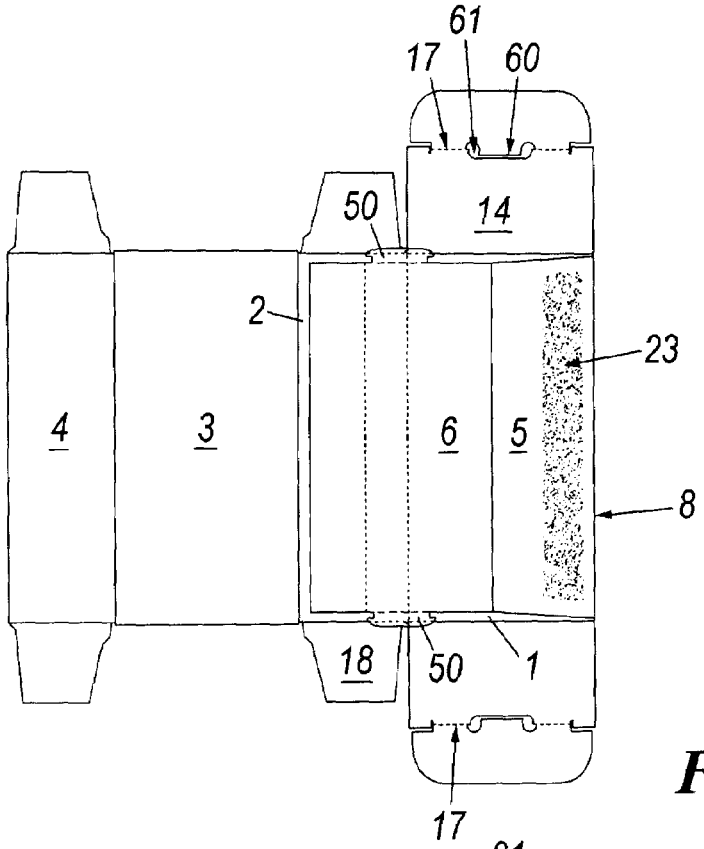

The panel 5 is then rotated (about the folding line 8) so that it rests on the surface of the panel 1, while the panel 6 rests partly on the said panel 1 and partly on the panel 2, the glue strip 21 making the end panel 7 securely adhere on the panel 2 (FIG. 3).

Figure 4:
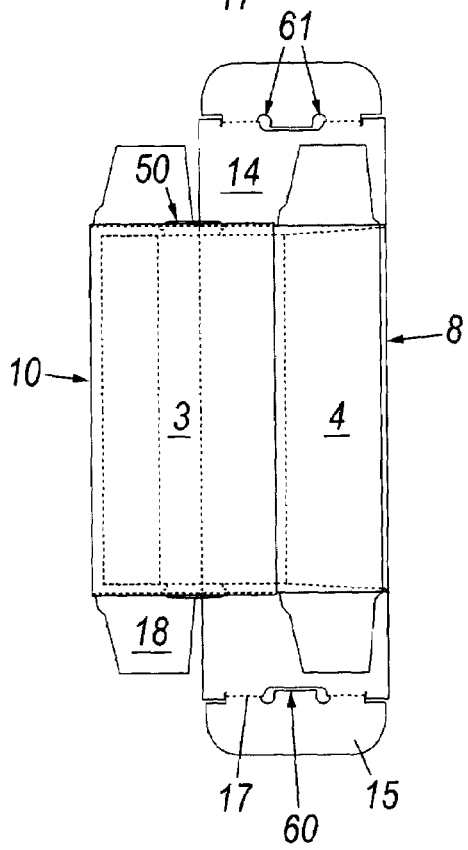

A glue strip 23 is then applied to the upwardly facing surface of the panel 5, after which the panel 3 is rotated about the folding line 10, to become superposed on the (upwardly facing) surface of the panel 6, whereas the panel 4 becomes superposed on the panel 5, to be fixed to it by the effect of the glue 23 (FIG. 4).

At this point, the cardboard processing firm which has produced the box has terminated its work and stacks of boxes in the state shown in FIG. 4 are delivered to the box user firms which, using automatic machines of known type working at high speeds, firstly exert a pressure between the longitudinal crease-lines 8 and 10, to press them towards each other and cause the box to assume the form shown in FIG. 6.

In FIG. 6, the box with its left end (with respect to the figure) completely open, and its main panel or wall 1 coplanar with the end panel 14 and with the respective lip 15 of the lid, shows that the supplementary wall 6 is close to (but not in strict contact with) the box side wall 3, i.e. that side wall 3 which opposes the side wall 1 from which the two box lids 14, 15 extend. To close the box, the flaps 18 are firstly folded towards the box interior and the lip 15 of the lid is rotated upwards (relative to the end panel 14-FIGS. 7 and 8 showing the box in perspective view, seen from its side and rear respectively, i.e. from the same side as the panel 1).

The lid is then rotated about the folding line 16 (FIG. 9) and the lip 15 of the lid is made to penetrate into the narrow space defined by the outer wall 3 and the supplementary panel 6 parallel to it.

The box structure and the characteristics described up to this point are known per se, as can be seen from the said EP 1826129 A2.

The new inventive characteristics of the box of the present invention will now be described. From the drawings, it will firstly be noted that from the free edge of the supplementary panel 6 there projects a hook-shaped appendix 50, the free end of which is widened and which (preferably but not necessarily) is separated from the panel 6 by a preferential breakage line 57 (see FIGS. 6, 7 and 9 in particular) which can consist of a knurling (in the sense of a succession of small cuts passing through the entire thickness of the cardboard) or a thin cut which incises only a part of the cardboard thickness: it should however be noted that this preferential breakage line 57 could also not exist.

It will be apparent that just one shaped appendix or more than one shaped appendix could project from just one or from both the opposing free ends of the panel 6.

It is also important to note that in the end panel 14 of the box lid (which extends from the same side of the shaped appendix 50) a cut 60 is provided (in practice the number of cuts 60 provided is equal to the number of shaped appendices 50) close to the folding line 17 which separates it from the respective free lip 15 (see FIG. 5 in particular, which represents on an enlarged scale the end portion of a box lid), this cut 60 having a length less than the width of the free end of the shaped appendix 50; at each end of the cut 60 a hole 61 is provided extending partially into the lid panel 14 outwards from the cut but mainly within the lip 15 (as seen in particular in FIG. 5), on which it defines a projecting appendix 80 extending (between the two holes 61) as far as the cut 60. From the figures it can be seen that a short cut is provided at the two end edges of the folding line separating the end panel 14 from the respective lip 15, to define at each end of the panel 14 a projecting appendix 14A coplanar with the panel 14. It is important to note that the length of the supplementary panel 6 considered as the distance between its free opposing edges is less than the length of the wall 3, i.e. of that box outer side wall opposite the wall 1 from which the lid 14, 15 extends, such that the free edge of the wall 6 is set back from the free edge of the wall 3, whereas the free end of the shaped appendix 50 projects beyond the free edge of said wall 3 which superposes it.

Having now described the general structure of the box, the functional characteristics will now be explained, starting for simplicity from a consideration of the figures subsequent to FIG. 6.

When the lip 15 of the lid is folded towards its panel 14 (FIGS. 7 and 8), the appendix 80 of the lip remains coplanar with the lip, its edge rising away from the cut 60 to form thereat an aperture or window 90 (FIGS. 8 and 9) having a width greater than the thickness of the cardboard and which—only at its parts most distant from the cut 60 (i.e. where the two holes 61 are provided)—has a length greater than the maximum width of the free end of the shaped appendix 50 (the length of this window 90—in correspondence only of the cut 60—being less than the maximum width of said shaped appendix).

It follows that, when the box lid is closed, to pass from the state of FIGS. 7 and 8 to that of FIG. 9 and from there (by sliding the lip 15 into the box interior between the walls 3 and 6) to that of FIGS. 10 and 11, the free end of the shaped appendix penetrates through the window 90, to extend beyond and to the outside of the panel 14, the shaped appendix 50 being urged (against the surface of the cut provided in the panel 14) by the appendix 80 which is in its turn pressed by the wall 3, as shown clearly in FIGS. 10 and 11. Given the described structure, when the lid is completely closed and the lip 15 has been totally inserted into the box interior into contact with the opposing surfaces of the walls 3 and 6, the hook-shaped part of the shaped appendix 50 rests on the outer surface of the lid panel 14 where it is retained by the appendix 80 of the lip 15 of the lid (FIGS. 10 and 11), while the panel 14 rests on the adjacent free edge of the supplementary panel 6, such that the folding line between the panel 14 and lip 15 is positioned below the free end of the panel 3 (FIGS. 10 and 11). The free ends of the appendices 14A projecting along the two outer edges of the panel 14 are also positioned below and in contact with the panel 3.

When the box is closed (FIGS. 10 and 11) it has a very high and surprising resistance to deformation, due mainly to the fact that the lid panel 14 is inserted, and securely retained by the shaped appendix 50, below the panel 3; to the fact that the lip 15 of the lid is retained between the panels 3 and 6 and that the width of this lip 15 is such that its outer side edges are in contact with the inner surfaces of the box side panels 2 and 4; and finally to the fact that the narrowest portion of the shaped appendix 50 is in contact with the side edges of the window 90, in the immediate vicinity of the cut 60.

When the box is to be opened, the lid panel 14 must be rotated outwards in the direction indicated by the arrows A in FIGS. 12 and 13. In this manner the appendix 50 is broken along its predetermined breakage line 57 (FIG. 12) or (if no breakage line 57 has been provided for the shaped appendix) along the predetermined breakage line separating the panel 14 from its lip 15 (FIG. 13), this line being represented as successions of small cuts or knurlings 17 in the drawings.

Predetermined breakage lines can be provided only along the narrowest part of the shaped appendix 50, or at the folding line between the panel 14 and its lip 15. In all cases a security seal is obtained which is totally inviolable and is reliably broken when the box is opened for the first time.

The invention claimed is:

1. A box, comprising:

a single piece of punched and crease-lined cardboard sheet, the box being of substantially parallelepiped shape including four outer side walls, two lids configured to close two box ends and each respective lid projecting from a respective end of one of said side walls, and a supplementary wall inside the box located close to said box side wall that opposes the one of said side walls from which said lids extend, wherein at least one lid of said two lids is divided into an end panel and into a free lip by a folding line substantially parallel to a folding line which separates the said end panel from the box side wall from which said at least one lid extends, wherein at least one hook-shaped appendix extends from at least one edge of said supplementary wall, a free end of said hook-shaped appendix is widened, wherein the end panel includes at least one cut close to the folding line which separates said cut from said free lip, wherein said cut is located in the end panel of the box lid on the same side as said hook-shaped appendix, said cut having a length less than the width of the free end of said hook-shaped appendix, wherein said hook-shaped appendix passes through and extends beyond the cut when the box lid is closed, wherein a hole is located at each of a first end and a second end of said cut in the lid panel, and said holes extend from each respective end of said cut in a direction towards the outside of the cut and into the lid lip, and wherein at least one preferential breakage line is located on at least one of said hook-shaped appendix or said box lid between the end panel and free lip, said preferential breaking line including at least one cut or knurling, wherein said knurling at least partially incises the cardboard.

2. A box as claimed in claim 1, wherein a length of the supplementary wall between opposing first and second free edges of the supplementary wall is less than the length of the outer box side wall opposite the side wall from which said lid extends.

* * * * *